United States Patent [19]

Bordini

[11] Patent Number: 4,608,810

[45] Date of Patent: Sep. 2, 1986

[54] VALVE ARRANGEMENT ON PACKING MACHINES

[75] Inventor: Giorgio Bordini, S. Prospero, Italy

[73] Assignee: Tetra Dev-Co, Modena, Italy

[21] Appl. No.: 757,951

[22] Filed: Jul. 23, 1985

[30] Foreign Application Priority Data

Jul. 31, 1984 [SE] Sweden ..... 8403923

[51] Int. Cl.[4] ..... B65B 37/00

[52] U.S. Cl. ..... 53/551; 53/554

[58] Field of Search ..... 53/551, 550, 552, 553, 53/554, 469, 451; 141/91, 48, 68

[56] References Cited

U.S. PATENT DOCUMENTS 3,488,914 1/1970 Csernak ..... 53/551 X
4,219,054 8/1980 Carter et al. ..... 53/469 X
4,352,977 10/1982 Hardigg et al. ..... 53/373 X
4,494,363 1/1985 Rica et al. ..... 53/469 X
4,524,563 6/1985 Sassi ..... 53/469 X

*Primary Examiner*—James F. Coan

*Attorney, Agent, or Firm*—Burns, Doane, Swecker & Mathis

[57] ABSTRACT

In packing machines of the type which manufacture packing containers with liquid contents a filling pipe with a valve arrangement situated at the outlet end is frequently used. The valve arrangement that is described comprises a movable valve element which is manoeuvred with the help of pressure variations in the filling pipe. The movable valve element is cup-shaped and is adapted so that it is lifted through excess pressure in the filling pipe from a fixed seat so that an annular discharge opening results.

22 Claims, 4 Drawing Figures

VALVE ARRANGEMENT ON PACKING MACHINES

FIELD OF THE INVENTION

The present invention relates to machines for filling containers, and more particularly to valve arrangements for such packing machines.

BACKGROUND OF THE INVENTION

Packing containers for food products in liquid or semi-liquid form, e.g. milk, soups or the like are manufactured generally from laminated, flexible material which comprises layers of paper and thermoplastics. A known packing container is formed from a laminated web, during its advance through the packing machine, which successively converts it to tubular shape. During the movement of the tube substantially downwards through the packing machine the contents are delivered via a delivery pipe extending into the tube. The continuously moving tube is pressed together at equally spaced intervals with the help of co-operating, reciprocating processing jaws situated at the lower end of the tube, so that transverse flattened zones result wherein the walls of the material tube are sealed to each other in a liquid-tight manner. The tube is thus converted to a coherent band of substantially cushion-shaped packing containers filled with contents. These are separated by means of cuts through the transverse sealing zones whereupon a final shaping process takes place to impart the desired, e.g. parallelepipedic, shape to the packing container.

The delivery of liquid contents which are free of solid particles can take place without interruptions in the manufacture of packing containers in the manner described above, since the sealing together of opposite walls of the packing material tube can be done without hindrance by the liquid. However, solid particles (bits of fruit, beans, asparagus etc.) have to be delivered in such a manner that they do not get caught or in some other manner prevent or impair the transverse sealing of the packing material tube. A preferred prior method to make this possible is to separate the liquid and the solid parts of the contents in advance and to deliver the solid particles (preferably blended with a certain amount of liquid) in the form of metered portions which are delivered to the tube in rhythm with the repeated transverse flattening of the tube. In this manner a metered amount of solid particles can be delivered as soon as a transverse sealing has been completed, whereupon the, continuous flow of liquid contents is preferably to fill the package to the desired volume before the next flattening will take place.

The delivery of the "solid" part of the contents (this designation will be used in the following description and claims for the part of the contents which includes solid particles in the form of fruit pulp, beans etc. blended with a greater or smaller amount of liquid) in the form of portions of a predetermined size is carried out with the help of a metering pump which feeds out from a storage container the solid part of the contents in portions in the delivery pipe to the packing material tube. Owing to the relatively great distance between the metering pump and the lower open end of the filling pipe, a number of portions will "be on the way" in the filling pipe during the continuous manufacture of packing containers. This means that the feeding out of the solid part of the contents at the lower end of the delivery pipe will be relatively uncertain inasmuch as the contents may stop in the pipe outlet or be pressed out too early so that the accuracy of volume as well as the synchronization with the repeated transverse flattening of the packing material tube will be unsatisfactory. Thus the danger of an incorrect amount of solid particles finding its way into the finished packing container is increased, and it cannot be wholly ruled out that the particles of contents may become stuck between the walls of the packing material tube in connection with the transverse sealing work.

In order to avoid this danger is has been proposed previously to provide the lower end of the filling pipe intended for solid particles with some form of valve which is opened and shut in rhythm with the rate of operation of the packing machine, that is to say in rhythm with the transverse sealings of the packing material tube. Although it is possible, of course, to place a conventional disc valve at the bottom end of the filling pipe and manoeuver the same by means of a spindle or a similar manoeuvring element extending vertically upwards through the filling pipe, this is a solution which should be avoided, if possible, because the number of parts in contact with the contents are increased which implies difficulties in the cleaning sterilizing of the machine.

It is a requirement, therefore, to provide a valve arrangement which has few movable elements and which can be placed at the lower end of the filling pipe and be made to open and shut for the contents containing solid particles in rhythm with the working stroke of the metering pump.

It is a further requirement to provide a valve arrangement of the abovementioned type by means of which the solid part of the contents can be proportioned out in such a manner that the desired amount of contents flows out at the desired instant without isolated particles of contents being delayed or getting stuck in such a manner that they interfere with the subsequent transverse sealing of the packing material tube.

OBJECTS AND SUMMARY OF THE INVENTION

It is an object of the present invention to provide a valve arrangememt which meets the abovementioned requirements and which is not subject to the disadvantages of earlier similar valve arrangements.

It is a further object of the present invention to provide a valve arrangement of the abovementioned type which not only safeguards that the correct amount of solid contents is proportioned out at the right instant, but which also ensures that the solid part of the contents flows out in such a manner that it, if possible, is blended into and washed away with the liquid contents flowing past.

It is another object of the present invention, moreover, to provide a valve arrangement which has a long service life, is uncomplicated and capable of being washed and sterilized by known means, as used in the food industry.

Finally, it is an object of the invention to provide a valve arrangement that is not hindered by solid particles of contents getting caught in the valve. The particles either must pass unhinderd or remain behind.

These and other objects have been achieved in accordance with the invention by a valve arrangement in which the second valve element is arranged to be stationary at a distance from the lower end of the delivery pipe. An annular discharge opening is provided between the valve element and the pipe outlet, and that the movable valve element is axially displaceable between an upper, open position and a lower position wherein it shuts the said discharge opening.

By designing the valve arrangement with one movable valve element which is acted upon between open and shut position by pressure variations in the contents, a valve arrangement that operates simply and safely is obtained. It has few movable parts and is therefore inexpensive to manufacture and reliable in operation. The absence of manoeuvring rods and the like, moreover, facilitates the cleaning sterilizing of the arrangement which is of great importance in machines used for the handling of foodstuffs.

The upwardly directed point or cone of the fixed valve element forms together with the downwardly directed shroud of the movable valve element a channel of narrowing area which ensures that the movable valve element is lifted in a safe and effective manner when the pressure in the inner filling pipe increases. When after the completed pumping stroke the pressure diminishes again and the desired amount of solid contents has passed the valve, the movable valve element drops again until its bottom sealing edge come to rest against the peripheral edge of the solid valve element. The narrow, linear contact between the two valve elements ensures a correct seal, at the same time as the danger of any solid particles of the contents getting stuck between the valve elements is considerably reduced.

DESCRIPTION OF THE DRAWINGS

Preferred embodiments of the valve arrangement in accordance with the invention are illustrated in the accompanying drawings, in which.

DETAILED DESCRIPTION

Figure 1:
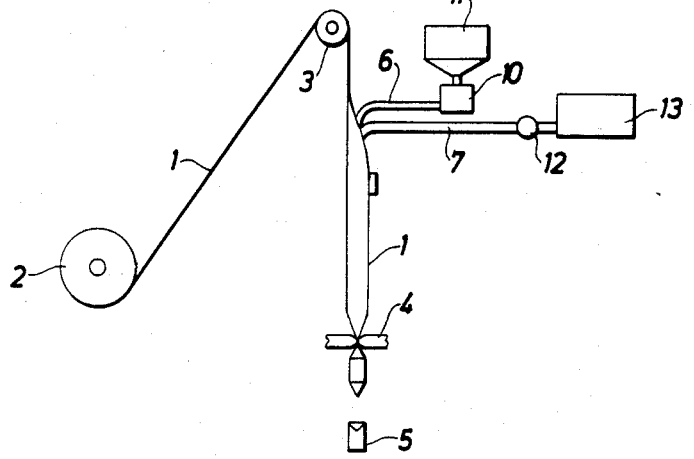
FIG. 1 is a schematic diagram of the forming of the material in a packing machine of known type in which the valve arrangement in accordance with the invention may be used.

The principle of formation shown in FIG. 1 for the manufacture of packing containers from flexible web-like material 1 is well known and the principle as well as packing machines working in accordance with the principle have been shown and described thoroughly in the technical literature. For a full understanding of the invention however the following short description of its function should be sufficient.

Packing material of the laminate type comprising a carrier layer of fibrous material, e.g. paper, which is coated on both sides with thermoplastic material, e.g. polyethylene, and possibly also comprising other layers of e.g. aluminium foil, is supplied to the packing machine in the form of a roll 2 from which the material web 1 is reeled off during the operation of the machine. After the unreeling the packing material web is passed substantially obliquely upwards through the machine whereby some processing e.g. the formation of crease lines, provision of opening arrangements, sterilizing treatment etc. may take place. After it has passed a reversal pulley 3 at the upper end of the machine the packing material web 1 is passed substantially vertically downwards. As it advances the material web is successively folded by its two longitudinal edges being brought closer together so that a hose or tube 1' is formed. The longitudinal edges of the material web are sealed together with the help of heat and pressure so that a longitudinal liquid-tight seal is produced. The material tube 1' so formed thereafter is passed further downwards through the packing machine and between co-operating pairs of sealing and cutting jaws 4 which are manoeuvred in repeated working and return strokes horizontally as well as vertically, so that the packing material tube 1' is provided with transverse, equidistant flattened areas. By the simultaneous heating of the thermoplastic layers of the packing material to the softening temperatures of the thermoplastics and pressing together the material tube with great force, the inside layers are joined together so that liquid-tight, transverse seals are produced in the flattened areas. Following this, the packing material tube is cut through in the sealed areas so that individual packing containers 5 result. The packing containers 5 are cushion-shaped and are usually subjected to further shaping work so that a substantially parallelepipedic shape is obtained. The cutting of the material tube 1', like the heating and flattening, can be carried out with the help of the processing jaws 4.

Into the upper, open end of the material tube 1' are introduced two filling pipes 6,7 which together form a delivery pipe 8 extending substantially downwards. The delivery pipe 8 which is formed of two filling pipes 6,7 running concentrically inside one another has a lower outlet end which is provided with a valve arrangement 9 in accordance with the invention and is situated at a little distance above the region wherein the processing jaws 4 operate. The vertical part of the filling pipe 6 situated in the packing material tube 1' is arranged concentrically inside the filling pipe 7 whilst its upper part extends out of the upper, open end of the packing material tube 1' and to a metering pump 10 which is connected to a store 11 for the solid contents. The filling pipe 7 likewise extends out of the upper, open end of the packing material tube 1' and is connected via valve and/or pump arrangement 12 to a tank 13 for the liquid contents.

Figure 2:
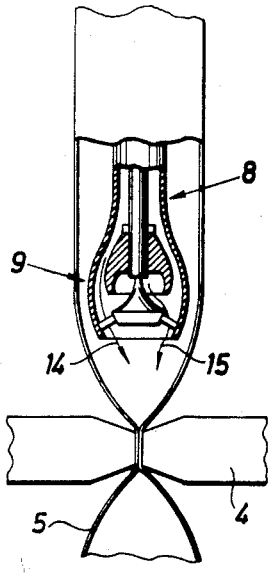
FIG. 2 is an elevational view partly in section of, the lower end of the packing material tube in the packing machine according to FIG. 1 with the valve arrangement in accordance with the invention visible.

As mentioned earlier, the valve arrangement in accordance with the invention is situated at the lower end of the delivery pipe 8, as illustrated in FIG. 2 where also the paths of flow for the solid and liquid parts respectively of the contents are indicated by means of arrows (arrow 14 indicates liquid contents, arrow 15 solid contents).

Figure 3:
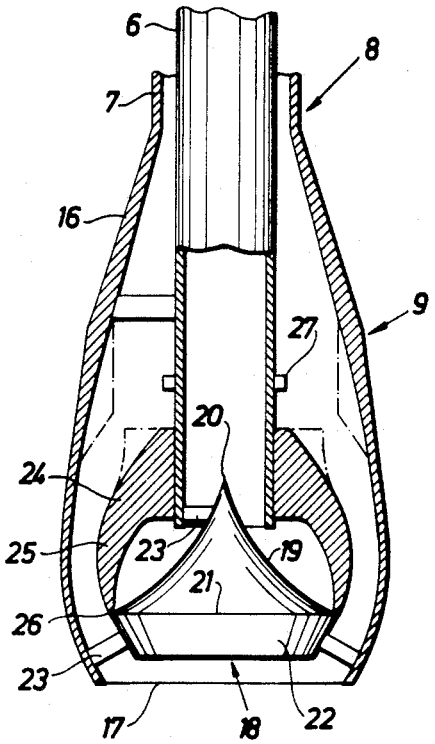
FIG. 3 is a cross-sectional view on a larger scale of a first embodiment of the valve arrangement in accordance with the invention.

FIG. 3 shows on a larger scale a section through the valve arrangement 9 in accordance with the invention when it is in shut position. It is evident from the figure how the valve arrangement is supported at the lower end of the delivery pipe 8 and how this is formed by the two concentric filling pipes 6,7. More particularly, the outer filling pipe 7 at its lower end changes into a widened portion which forms a housing 16 for the valve arrangement. The diameter successively increases in downwards direction so that the passage in the housing 16, during the greater part of its length, has an elongated conical form. At the lower end the passage narrows and forms an outlet 17 with walls curved a little inwards.

The lower end of the filling pipe 6 is situated at some distance above the outlet 17 and the discharge end of the filling pipe 6 is thus inside the housing 16, substantially on a level with the transition between the conical part of the housing 16 and its lower, inwardly curved part. In the space between the lower end of the filling pipe 6 and the outlet 17 a fixed valve element 18 is provided which has an upwardly directed conical or pointed surface 19 whose point 20 directed upwards extend somewhat into the outlet of the inner filling pipe 6. The fixed valve element has near its lower end a circular, peripheral sealing edge 21 and its lower end is preferably terminated for fluidic reasons by a downwardly directed conical part 22. The fixed valve element 18 is supported in the housing 16 by means of spacer or fixing elements 23 which join the fixed valve element 18 to the lower end of the housing 16, and may also join the upper end of the valve element to the lower end of the filling pipe 6. The fixing elements 23 are streamlined so as to avoid disturbances in the flow of liquid when the valve arrangement is in operation.

A movable valve element 24 co-operating with the fixed valve element 18 is supported so that it is axially movable on the lower end of the filling pipe 6. The movable valve element 24 is cup or bell-shaped with a downwardly directed shroud 25 whose lower end is designed as a circular sealing surface 26 co-operating with the fixed valve element. The sealing surface 26 and the sealing surface 21 of the fixed valve element 18 in the shut position of the valve arrangement rest against each other along a linear edge extending around the periphery of the fixed valve element. This ensures that the outlet opening of the inner filling pipe 6 is wholly blocked. The downwardly directed shroud of the movable valve element 24 is substantially bell-shaped or conical. Between the inner surface of the shroud 25 and the upwardly directed pointed or conical part of the fixed valve element 18 an annular channel is formed which in the shut position of the valve narrows in downwards direction. Thus the free space between the inside of the shroud 25 and the conical surface of the fixed valve element 18 seen in the direction of flow of the contents will be reduced. The reason for this will be explained in more detail in the following.

The movable valve element 24, as mentioned earlier, is supported so that it can move axially on the outside of the inner filling pipe. The vertical movement of the movable valve element 24 is limited in upwards direction by means of a stop 27 on the fixed filling pipe and in downwards direction through engagement between the sealing surfaces 21,26 on the fixed and the movable valve element respectively.

During operation of the arrangement in accordance with the invention the packing material web 1 is fed with the help of the forming jaws 4, and the packing material tube 1' thus moves continuously in downwards direction through the machine at the same time as its lower end is converted to individual packing containers 5 filled with contents. The contents are delivered continuously to the lower end of the packing material tube 1' via the delivery pipe 8. More particularly, the liquid part of the contents is delivered from the tank 13 via a pump or a constant flow valve 12 and the pipe 7 in a continuous flow to the lower end of the delivery pipe 8 at the same time as the solid contents (that is to say solid particles, e.g. fruit pulp, beans etc. in a certain amount of liquid) are fed with the help of the metering pump from the storage tank 11 and via the inner filling pipe 6 to the lower end of the delivery pipe 8. The solid contents, that is to say the suspension of solid particles or fibres in liquid contents, are pumped with the help of the metering pump in an intermittent flow, each pump stroke feeding out a predetermined, metered amount suitable for each individual packing container.

During operation, the liquid part of the contents thus flows via the outer filling pipe 7 and its lower part designed as ventil housing, past the outer surface of the movable valve element 24 and out of the annular outlet 17 of the delivery pipe 8 which is limited by the lower, streamlined part 22 of the fixed valve element and the curved-in edge on the lower end of the housing 16. The flow of liquid contents thus converges when it leaves the delivery pipe and is directed towards the center axis of the packing material tube 1'. The flow is preferably continuous and the lower end of the tube is filled, therefore, successively with liquid contents. The intermittent flow of solid contents is interrupted during a time and the metering pump 10 is thus at standstill. Hence no solid contents flow through the filling pipe 6 and the movable valve element 24 is in its lower position (FIG. 3) so that its sealing surface 26 rests tightly against the sealing surface 21 of the fixed valve element 18.

As soon as the two co-operating processing jaws 4 have pressed together a transverse section of the packing material tube 1' at some distance below the outlet of the delivery pipe 8, and have commenced the sealing work, the metering pump 10 carries out a working stroke which results in a predetermined amount of contents being transferred from the storage tank 11 to the filling pipe 6. When this happens the pressure in the filling pipe 6 increases so that the amount of solid contents flowing forwards give rise to a lifting force upon the inner, bell-shaped surface of the movable valve element 24. The movable valve element 24 is then lifted against the effect of gravity and of the downwards directed force which the liquid part of the contents flowing outside the valve element exercises until its upper end comes to lie against the stop 27. In the course of this the annular sealing surface 26 has left the sealing surface 21 of the fixed valve element 17 and an annular opening results. Controlled by the conical or pointed upper part of the fixed valve element, the solid contents flow outwards in a conical annular stream between the two separated sealing surfaces 26 and 21. In the course of this the solid contents come into directed contact with the liquid part of the contents flowing forwards at a relatively high speed and are blended with the same and follow downwards and flow out through the annular opening between the streamlined lower part 22 of the fixed valve element and the limiting surface of the outlet opening 17 formed by the lower end of the delivery pipe 8.

Owing to the solid part of the contents being conducted out into the liquid part of the contents flowing past at high speed, an effective admixture is taking place at the same time as the liquid part of the contents carries along the solid particles so that the danger of the solid particles getting stuck at the lower end of the delivery pipe 8 will be appreciably reduced. Since the inner surface of the housing 16 is conical, the lifting of the movable valve element 24 will somewhat reduce the annular opening between the outer surface of the movable valve element 24 and the inner wall of the valve housing 16 which the liquid contents have to pass. This and this increases further its speed and ensures that an effective washing down of the lower end of the valve housing 16 is taking place and that all residues of solid contents are safely removed and washed down into the packing material container which at the same time is being formed by the lower end of the packing material tube 1'.

As soon as the required amount of contents has been pumped out through the lower end of the filling pipe 6 the working stroke of the metering pump 10 is discontinued. As a result the pressure in the inner filling pipe is reduced so that the solid contents are no longer capable of lifting the movable valve element 24 to the upper, open position. Owing to the combined effect of the force of gravity and the pressure from the liquid contents flowing forwards in the reduced space between the movable valve element 24 and the inner wall of the housing 16 the movable valve element 24 will be pressed downwards in the direction towards closed position until its annular sealing surface 26 comes to rest against the sealing surface 21 of the fixed valve element 18 and discontinues the passage of solid contents. This effect is enhanced further by the metering pump 10 creating at its return stroke a certain underpressure in the filling pipe 6 which increases the pressure differential between the space on the outside of the movable valve element 24 and the space on its inside. The valve element 24 is then maintained closed until the underpressure in the inner filling pipe 6, in connection with the next pumping stroke of the metering pump 10, changes once more into an overpressure of sufficient magnitude for the valve element to be lifted.

When pumping certain products (e.g. those which contain solid particles of elongated shape, e.g. asparagus soup) in the inner filling pipe 6, a somewhat modified design of the movable valve element 24 may contribute to ensuring an effective closure (and in some cases also a cutting of solid particles which at the instant of closure happen to be between the two sealing surfaces 21,26) as solid contents are not to pass the valve arrangement in accordance with the invention. In this case the pressure from the liquid contents flowing on the outside of the movable valve element is made use of in a more effective manner in that the upper end of the movable valve element 24 is given a larger diameter or an outwardly directed flange which, especially in the open position of the valve, reduces the free, annular space between the valve element 24 and the inner surface of the housing 16 to a greater degree than is the case in the embodiment shown in the figures. At the same time the inner surface of the housing 16 can be given a somewhat different design with a narrowing section on a level with the upper part of the movable valve element 24, as a result of which the liquid part of the contents can be made to contribute to the shutting of the movable valve element 24 as required. This alternative embodiment is indicated by means of dash-dotted lines in FIG. 3, but it is obvious that the version described and shown here is only one of many, and that the embodiment can be adapted in an endless number of ways within the scope of the claims following hereinafter to give the desired effect for a certain combination of viscosity and quantity of the contents. It is even possible, should this be required, to design the parts in such a manner that a complete shutting off of the passage of the liquid part of the contents takes place when the valve element 24 is in its upper position. This may be appropriate under certain circumstances, e.g. when the amount of solid contents in each packing container is large in relation to the liquid, since it is possible in this manner to accumulate the liquid part so that a greater quantity of liquid contents remains for the washing down of the valve arrangement when the flow of the solid part of the contents has been stopped. In this connection it would also be suitable to substitute the constant flow valve 12 by a metering pump so that the liquid part of the contents too can be pumped intermittently. In practice the appropriate version and design can be chosen in each individual case, just as the other dimensions of the valve arrangement, sectional areas of flow and the like can be adapted to the particular case and in most cases it should be possible through suitable adaptation of the sectional areas of flow to obtain such a balance in the construction that the movable valve element can move to and fro in a pistonlike manner merely under the influence of the passing flows of contents.

Within the scope of the concept of the invention it is possible to design the valve arrangement in accordance with the invention in a different manner without the construction or the function of the same being appreciably altered. The embodiment chosen may be determined in each individual case depending on external conditions, e.g. the type of product which is to be filled, the filling rate, the ratio between solid particles and liquid contents, the quantity of contents, the available space and other practical circumstances.

Figure 4:
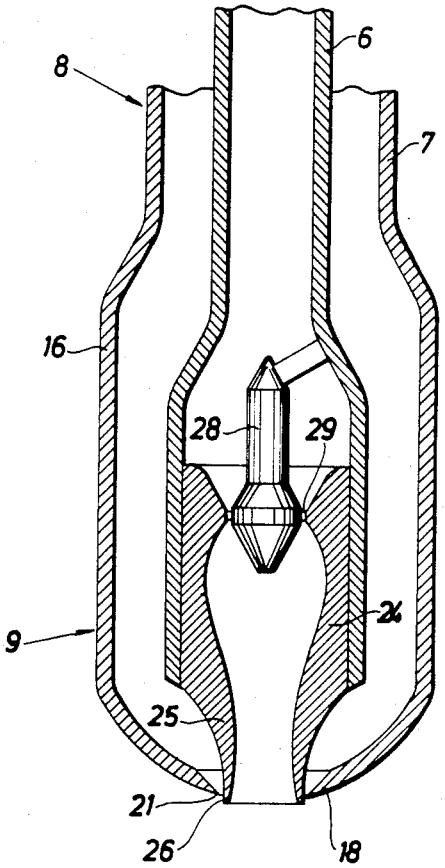
FIG. 4 is a cross-sectional view of a second embodiment of the valve arrangement in accordance with the invention.

A second embodiment of the valve arrangement in accordance with the invention is shown in FIG. 4 wherein parts whose function correspond to those of parts in FIGS. 2 and 3 have been given corresponding reference numerals. This second embodiment is particularly suitable in those cases where the proportion of solid contents is relatively great in relation to the proportion of liquid contents, since owing to the shape of the valve arrangement the solid contents are delivered in a more concentrated manner, so that the need for washing down by means of the liquid part of the contents is reduced. The function of the outer and inner filling pipe respectively is reversed in relation to the first embodiment described earlier and the inner filling pipe 6 in the second embodiment thus serves for conducting the liquid contents flow whilst the solid or particulate contents flow in the outer filling pipe 7.

As in the first embodiment of the valve arrangement in accordance with the invention, a widened portion of the outer filling pipe 7 is present at the lower end of the delivery pipe 8 which portion serves as a valve housing 16 for the valve arrangement 9 in accordance with the invention. The fixed valve element 18 is situated at the lower end of the delivery pipe 8 and may be formed in one piece with the housing 16 whose lower end narrows in the direction towards the downwardly open outlet. The fixed valve element 18 thus constitutes a part of the lower end of the outer filling pipe 7 and may be made as an integral of the latter or it may be designed as a separate, annular part which, for example, is screwed down into the lower end of the outer filling pipe 7. The sealing edge 21 of the fixed valve element 18 extends in ring shape around the outlet opening and is adapted so as to co-operate with the sealing surface 26 located at the lower end of the movable valve element 24. This movable valve element 24 is supported by the inner filling pipe 6 and is vertically displaceable between an upper position in which its sealing surface 26 is at a distance from the sealing edge 21 of the fixed valve element 18 and a lower position in which the sealing surface 26 rests against the sealing edge 21 and closes the outlet for the solid contents. The sealing surface 26 is a substantially cylindrical outer surface which constitutes the lowermost closure of the conical or curved shroud 25 of the movable sealing element 24 which just as in the first embodiment of the valve arrangement in accordance with the invention forms an annular channel between itself and the fixed valve element 18 which in the shut position of the valve narrows in downwards direction. Thus the free space between the outside of the shroud 25 and the inside of the fixed valve element 18 is reduced, seen in the direction of flow of the solid contents, which means that when the pressure increases the solid contents will act upon the outer surface of the shroud 25 so that the movable valve element 24 is lifted and the passage between the movable and the fixed valve elements is freed so that the solid or particulate contents can flow out.

In the centre of the movable valve element a vertical opening is provided which constitutes a continuation of the inner filling pipe 6. Through this opening the liquid contents can flow continuously at the required rate. If the liquid contents are to be utilized as in the first embodiment to return the movable valve element 24 to the shut position the inner filling pipe 6 can be provided with a constriction body 28 which by means of spacer elements is placed concentrically in the inner filling pipe 6 on a level with (approximately) a restricted area 29 in the central opening of the movable valve element 24. When the movable valve element 24 during delivery of solid contents is lifted, the space between the constriction body 28 and the restriction 29 in the central passage of the movable valve element will be widened so that the downward force excerted on the movable valve element 24 by the liquid flow is decreased. When the flow of solid contents is interrupted the delivery pump creates a short under-pressure on the lower side of the movable valve element 24 so that the movement of the valve element 24 in downwards direction is initiated. This means that the space between the constriction body 28 and the restriction 29 in the central opening of the valve element is successively reduced, which increases the pressure in the inner filling pipe 6 so that the movable valve element 24 is acted upon again in downwards direction towards the shut position. Simultaneously, the increased pressure inside the filling pipe 6 causes the liquid to flow faster, and as in the earlier described embodiment of the invention it may be advantageous to use the liquid stream for cleaning purposes. In order to direct the liquid stream towards the inner surface of the packing material tube it is further possible to arrange some kind of spreader, for example a conical element, in the liquid stream close to the lower end of the movable valve element. The spreader can for example be adjustably mounted on the lower end of a rod, the upper end of which is connected to the constriction body 28, and create a ring-shaped, conical outlet that directs the stream towards the tube.

For the rest, the second embodiment of the valve unit in accordance with the invention functions in a manner which wholly corresponds to that of embodiment described previously, so that its function does not have to be described in detail. Certain further modifications are of course possible in both embodiments and it is feasible, for example, to manoeuver the movable valve element with the help of a booster force supplied, for example, by a spring integrated in the valve unit, if the forces of the two flows of contents acting upon the movable valve element for any reason are insufficient for a satisfactory manoeuvring (for example when the flow of liquid in the inner filling pipe is very small). External manoeuvring elements too can be used of course, but they complicate the construction and make cleaning and washing more difficult so that these solutions as far as possible should be avoided.

Although the embodiments shown have been found to be usable in the majority of cases and have also proved to function very well and reliably in practice, it is of course possible by different means to modify the valve arrangement in accordance with the invention. Thus it is possible e.g. to adapt the construction so as to be used when only one filling pipe is to be operated. This means of course that one filling pipe is eliminated and that the valve element must be supported and designed therefore in a slightly different manner and be provided with suitable manoeuvring elements, springs etc. The rest of the construction, though, can remain unchanged. This variant is very suitable for the metered filling of contents in the manufacture of packing containers from tubular material as well as from preformed blanks.

I claim:

1. A valve arrangement on a packing machine comprising a delivery pipe for contents extending substantially vertically and two co-operating valve elements situated at the lower end of the pipe, one of which is movable between an open and a shut position, the second valve element being arranged to be stationary at the lower end of the delivery pipe, the movable valve element being axially displaceable between an upper, open position in which an annular discharge gap is formed between the valve elements and a lower position in which it shuts the said discharge gap.

2. A valve arrangement in accordance with claim 1, wherein the movable valve element is annular, its upper end being supported so that it can slide on the delivery pipe and its lower end having a circular sealing surface co-operating with the fixed valve element.

3. A valve arrangement in accordance with claim 1, the fixed valve element has a peripheral sealing surface co-operating with the movable valve element.

4. A valve arrangement in accordance with claim 2, wherein the movable valve element has a downwardly directed shroud at the lower end of which is formed the sealing surface.

5. A valve arrangement in accordance with claim 1, wherein the movable valve element is spring-loaded.

6. A valve arrangement in accordance with claim 1, wherein the delivery pipe is doubled and comprises two co-axial filling pipes, the movable valve elements being supported on the inner filling pipe and being adapted so as to co-operate with the second valve element which is situated co-axially in relation to the outer filling pipe.

7. A valve arrangement in accordance with claim 6, wherein each of the two valve elements is supported by its filling pipe.

8. A valve arrangement in accordance with claim 6, wherein the lower end of the outer filling pipe has a narrowing part seen in the direction of flow.

9. A valve arrangement in accordance with claim 6, the fixed valve element forms a part of the lower end of the outer filling pipe.

10. A valve arrangement in accordance with claim 6, the diameter of the fixed valve element is smaller than the corresponding inside diameter of the outer filling pipe on a level with the valve element, spacer elements being arranged to maintain the valve element in position at the lower end of the outer filling pipe.

11. A valve arrangement in accordance with claim 6, wherein the outer filling pipe has a constriction situated on a level with the upper end of the movable valve element, so that the free area between the outer surface of the movable valve element and the outer filling pipe is reduced when the valve is in the open position.

12. A valve arrangement in accordance with claim 9, wherein a constriction body is arranged in the inner filling pipe on a level with the upper end of the movable valve element, so that the free area between the movable valve element and the constriction body is set to be diminished when the valve element is in its upper position.

13. A valve arrangement on a packing machine comprising a delivery pipe for contents extending substantially vertically and two co-operating valve elements situated at the lower end of the pipe, one of which is movable between an open and a shut position, the second valve element being arranged to be stationary at the lower end of the delivery pipe, the movable valve element being axially displaceable between an upper, open position in which an annular discharge gap is formed between the valve elements and a lower position in which it shuts the said discharge gap, the movable valve elements having a downwardly directed shroud at the lower end of which is formed the sealing surface, the movable valve element being annular with its upper end being supported so that it can slide on the delivery pipe while its lower end has a circular sealing surface co-operating with the fixed valve element, the downwardly directed shroud being conical or curved and extending at such an angle that the free space between the surface of the shroud and the surface of the fixed valve element is diminished when viewed in the direction of flow of the contents.

14. A valve arrangement on a packing machine comprising a delivery pipe for contents extending substantially vertically and two co-operating valve elements situated at the lower end of the pipe, one of which is movable between an open and a shut position, the second valve element being arranged to be stationary at the lower end of the delivery pipe, the movable valve element being axially displaceable between an upper, open position in which an annular discharge gap is formed between the valve elements and a lower position in which it shuts the said discharge gap, the fixed valve element having a peripheral sealing surface co-operating with the movable valve element, and the fixed valve element having an upwards directed conical surface or point.

15. In a packing machine of the type in which a flexible web of packaging material is continuously formed into a vertical tube and clamping jaws flatten and seal the tube at successive intervals to form simultaneously the top closure of the lower packing container and the bottom of the next higher container, and having supply means for supplying the contents to the interior of the tube to be enclosed within the container, the improvement comprising:

a delivery pipe extending vertically in the interior of said tube, said pipe having an outlet, said delivery pipe having an inner filling pipe and an outer filling pipe mounted co-axially to form an annular fluid passage between said inner and outer pipe, and valve means adjacent said discharge opening, said valve means having a movable valve element supported on said inner pipe and movable between an open and closed position, said valve element having a sealing surface to seal against the flow of fluid and having a pressure responsive surface arranged to displace said element relative to said inner pipe toward said open position thereby displacing the sealing surface and allowing the flow of fluid through said outlet.

16. A packing machine in accordance with claim 15 including means for supplying liquid contents to said discharge opening through said annular fluid passage and for supplying solid contents through said inner pipe.

17. A packing machine in accordance with claim 16 including a fixed valve element between said inner pipe and said delivery pipe outlet, said movable valve element sealing surface co-operating with said fixed valve element to stop fluid flow from said inner pipe, while allowing fluid flow from said outer pipe through said outlet.

18. A packing machine in accordance with claim 17 wherein said pressure responsive surface is arranged to displace said movable element away from said fixed element in response to fluid pressure in said inner pipe.

19. A packing machine in accordance with claim 15 including means for supplying solid contents to said discharge opening through said annular fluid passage and for supplying liquid contents through said annular fluid passage.

20. A packing machine in accordance with claim 19 wherein said delivery pipe outlet has a sealing surface, said movable element sealing surface in said closed position co-operating with said outlet sealing surface to stop fluid flow from said outer pipe, said movable element including passage means between said inner pipe and said outlet to allow flow of fluid from said inner pipe when said element is in said closed position.

21. A packing machine in accordance with claim 20 wherein said pressure responsive surface is arranged to displace said movable element away from said outlet sealing surface in response to fluid pressure in said outer pipe.

22. A packing machine in accordance with claim 21, wherein said passage means includes constriction means for increasing the flow area of said passage means when said movable element is in said open position and reducing the flow area as said movable element moves toward said closed position.

* * * * *